US007128011B2

(12) United States Patent
Altland et al.

(10) Patent No.: US 7,128,011 B2
(45) Date of Patent: Oct. 31, 2006

(54) REMOTE TILLER CONTROLLER

(76) Inventors: Thomas L. Altland, 915 Lincoln Way E., Massillon, OH (US) 44646; James H. Altland, 915 Lincoln Way E., Massillon, OH (US) 44646

( * ) Notice: Subject to any disclaimer, the term of this patent is extended or adjusted under 35 U.S.C. 154(b) by 0 days.

(21) Appl. No.: 11/158,208

(22) Filed: Jun. 20, 2005

(65) Prior Publication Data

US 2005/0279267 A1 Dec. 22, 2005

Related U.S. Application Data

(60) Provisional application No. 60/581,570, filed on Jun. 21, 2004.

(51) Int. Cl.
*B63H 25/06* (2006.01)

(52) U.S. Cl. ..... 114/162; 114/144 A

(58) Field of Classification Search ..... 114/62, 114/144 A

See application file for complete search history.

(56) References Cited

U.S. PATENT DOCUMENTS 1,118,930 A * 12/1914 Hallongren ..... 440/60
1,392,394 A * 10/1921 Brousseau ..... 114/159
3,018,669 A * 1/1962 Bennett ..... 74/473.3
5,439,401 A * 8/1995 Clark ..... 440/6

* cited by examiner

*Primary Examiner*—Stephen Avila
(74) *Attorney, Agent, or Firm*—Zollinger & Burleson Ltd.

(57) ABSTRACT

A remote tiller control system includes a drive unit mounted to the tiller. The drive unit is adapted to move the tiller back and forth when selectively powered. A handheld remote control transmitter unit is provided to remotely control the drive unit and thus the position of the tiller. The drive unit includes a motor-drive gear that engages a curved rack. The motor is fixed to the tiller while the rack is fixed to a control arm. The end of the control arm is tied off to the boat to create the leverage needed to counteract the steering force on the tiller. Rotation of the gear against the rack creates a moment which drives the tiller.

16 Claims, 9 Drawing Sheets

REMOTE TILLER CONTROLLER

CROSS REFERENCE TO RELATED APPLICATIONS

This application claims priority from U.S. provisional patent application Ser. No. 60/581,570 filed Jun. 21, 2004; the disclosures of which are incorporated herein by reference.

BACKGROUND OF THE INVENTION

1. Technical Field

The present invention generally relates to remote controlled steering units for boats and, more particularly, a remote control steering unit that works with a tiller such as a tiller on a small sailboat. Specifically, the present invention relates to a remote control tiller driver that is mounted to the tiller itself and fixed to the hull with unobtrusive stays to provide the leverage for turning the boat.

2. Background Information

Various types of small boats use a tiller to steer the boat. Tillers are the elongated arms connected the rudder of a sailboat. The tiller extends into the cockpit to allow the captain to vary the position of the rudder while the boat is underway. A tiller on a motorboat may be the handle that extends forwardly into the cockpit from the motor mounted to the stern of the boat. The motor has a leg that extends into the water. The leg supports a propeller and may support a rudder. In both situations, the captain of the boat uses the tiller to control the direction of the boat by moving the tiller back and forth in an arc with respect to the hull of the boat. The tiller is pivotably mounted to the hull such that the rudder turns the opposite direction of the tiller.

There are numerous times on a boat when the captain needs to release the tiller and move about the boat. Such situations include the need to tighten sheets, drop anchors, go below, or fend off a pier or another boat. Although an experienced captain may temporarily tie off a tiller and perform these tasks, the nature of a moving boat on water—especially in sailboat—requires almost constant adjustment of the tiller position to maintain a steady course. The captain thus desires a device that allows the steering system to be controlled remotely so that the captain may adjust the course from any position on the boat. The device should be designed so that it may be retrofit to existing steering systems without the need for extensive modifications to the system or the hull of the boat. The system should also be portable so that the system does not encumber the captain as he moves about the boat. The system should also be easy to use so that the steering system may be controlled while the captain is performing other tasks. The system should also be relatively weather-proof so that is not damaged when exposed to bad weather.

BRIEF SUMMARY OF THE INVENTION

The invention provides a steering control system that allows the captain of a boat to remotely control the boat's steering system.

In one configuration, the invention provides a remote tiller control system having a drive unit mounted to the tiller. The drive unit is adapted to move the tiller back and forth when selectively powered. A handheld remote control transmitter unit is provided to remotely control the drive unit and thus the position of the tiller. A control arm extends from the drive unit and is tied off to a portion of the boat to provide the leverage needed to counteract the steering force on the tiller.

In another configuration, the transmitter unit transmits a radio frequency signal to a receiver. The receiver is connected to a controller that controls a motor which drives a gear. The motor is fixed with respect to the tiller. The gear meshingly engages a rack that is fixed with respect to a control arm. The rack pivots with respect to the motor. Rotation of the gear creates a moment which drives the tiller in one direction. Rotating the gear in the opposite direction creates a moment in the opposite direction to move the tiller in the opposite direction. The captain may thus control the direction of the tiller from a location remote from the tiller.

In another configuration, pulleys are supported by the tiller with stays wrapped around the pulleys. A motor is used to drive the pulleys and thus pull the tiller in one direction or the other.

BRIEF DESCRIPTION OF THE SEVERAL VIEWS OF THE DRAWINGS

Similar numbers refer to similar parts throughout the specification.

DETAILED DESCRIPTION OF THE INVENTION

Figure 1:
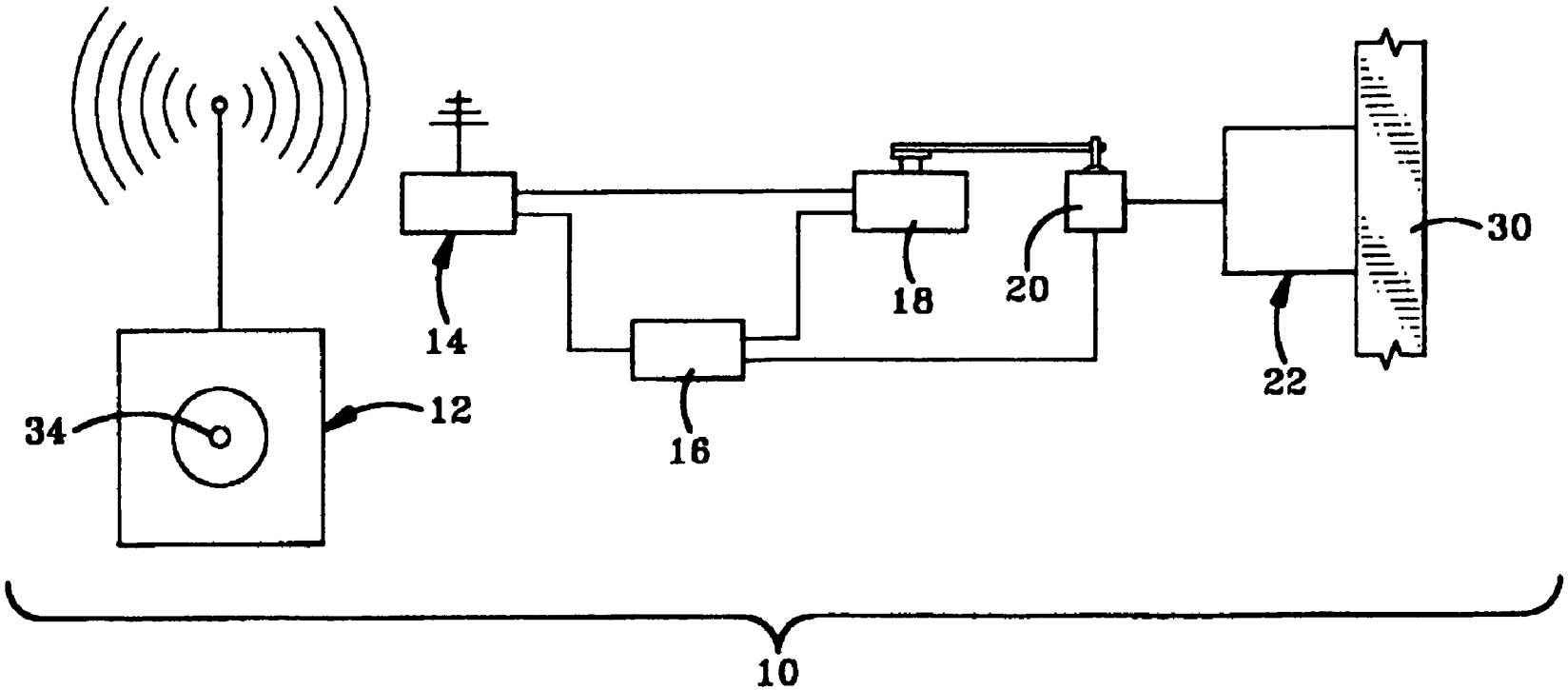
FIG. 1 is a schematic view of one configuration of the remote tiller controller of the present invention.

The first and third configurations of the remote tiller controller of the present invention are indicated generally by the numeral 10. Controller 10 generally includes a remote control transmitter unit 12 and a drive unit 22 adapted to receive a signal from transmitter unit 12 and control the direction of a tiller 30 with respect to the hull of a boat 32. In the first configuration shown in FIG. 1, controller 10 also includes a receiver 14, a power source 16, a servo 18, and a motor switch 20. Controller 10 may be used to control the position of tiller 30 from any location where unit 12 can successfully transmit a signal to receiver 14. Controller 10 may thus be used by a captain who needs to move about boat 32 to locations where he cannot directly grasp tiller 30. Controller 10 also may be used by a captain who is knocked overboard in order to steer the boat into the wind in order to give him time to rejoin the boat.

In general, the user of controller 10 may control the position of the tiller 30 on a boat 32 by manipulating a switch 34 on remote control transmitter 12. In one configuration, transmitter 12 may be worn on the wrist of the user. Switch 34 may have a neutral position, a left position, and a right position. When the user moves switch 34 to one of the left and right positions, transmitter 12 creates a signal that is received by receiver 14. Receiver 14 creates a command signal that directs drive unit 22 to move the steering system of the boat in the direction that corresponds to the signal created by unit 12. In the exemplary embodiment, the command signal is created by communicating the signal to servo 18 which moves in the direction commanded by the position of switch 34. Servo 18 is connected to motor switch 20 such that movement of servo 18 causes motor switch 20 to move from a neutral position to one of two powered positions. The two powered positions provide current to drive unit 22 in two different directions causing drive unit 22 to move in one direction or the other. Motor switch 20 may also be a self-centering switch such that it automatically returns to the neutral position when the user returns switch 34 to its neutral position. Switch 34 may also be a self-centering switch that automatically returns to its neutral position. Other methods of creating the command signal may also be used with the invention. For instance, in the third configuration of the invention, receiver 14 is connected to a controller 15 that directly controls drive unit 22. Transmitter 12 may also be hard wired to drive unit 22 for use by the captain in selected locations. Multiple transmitters 12 also may be used where one is hard wired at a selected location and another is wireless. For example, transmitter 12 and receiver 14 may incorporate spread spectrum, frequency hopping technology to activate relays that control the motor.

Remote control 12, receiver 14, power source 16, and servo 18 may be the typical components used with a remote controlled hobby vehicle such as a remote control car, boat, or airplane. Transmitter 12 may be powered by its own batteries 16. Drive unit 22 may be powered by separate batteries 16 or a power source (such as a generator or a battery) 16 on boat 32.

Figure 7:
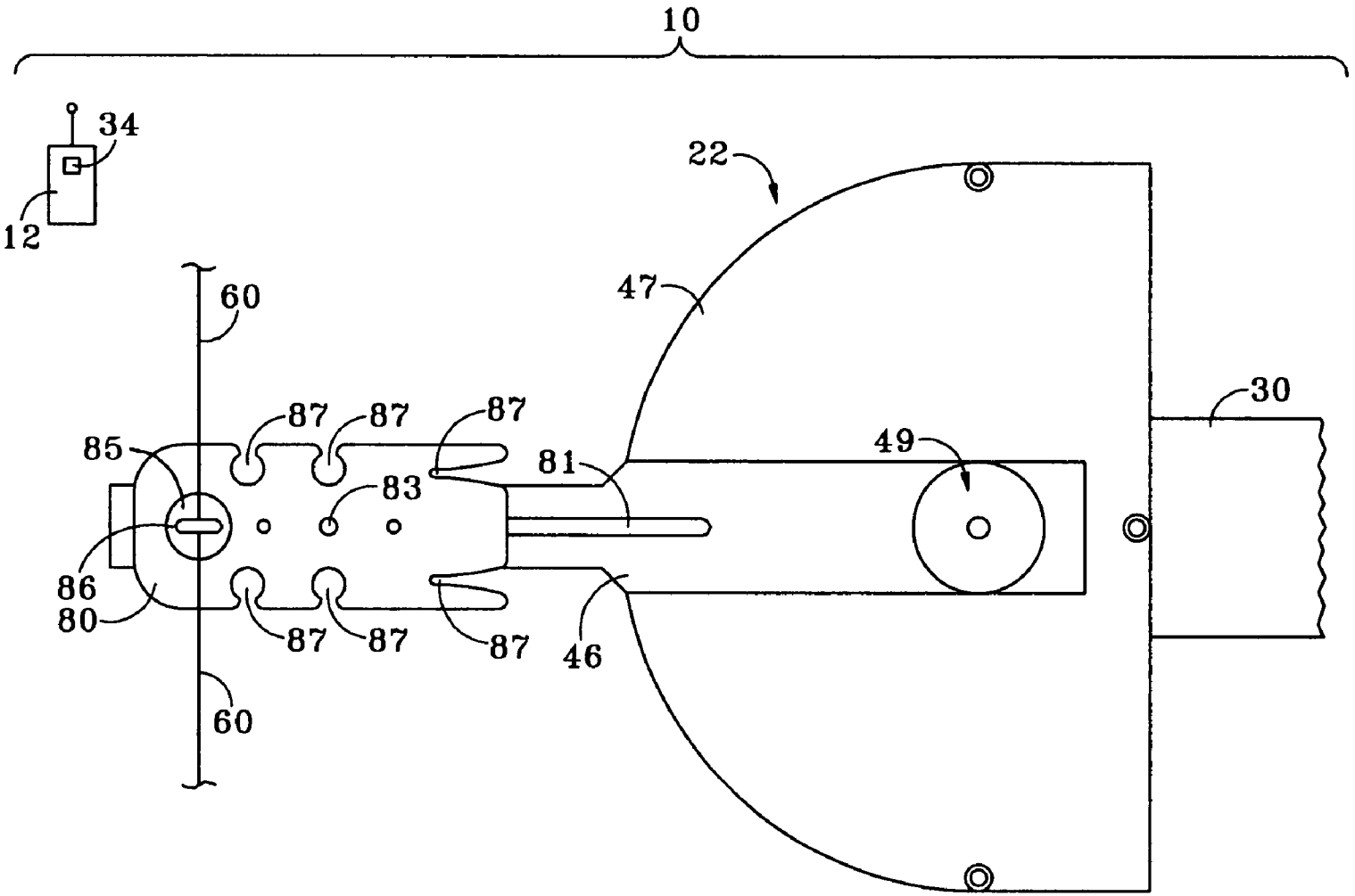
FIG. 7 is a top plan view of a third configuration of the remote tiller controller of the invention installed on a tiller.
Figure 8:
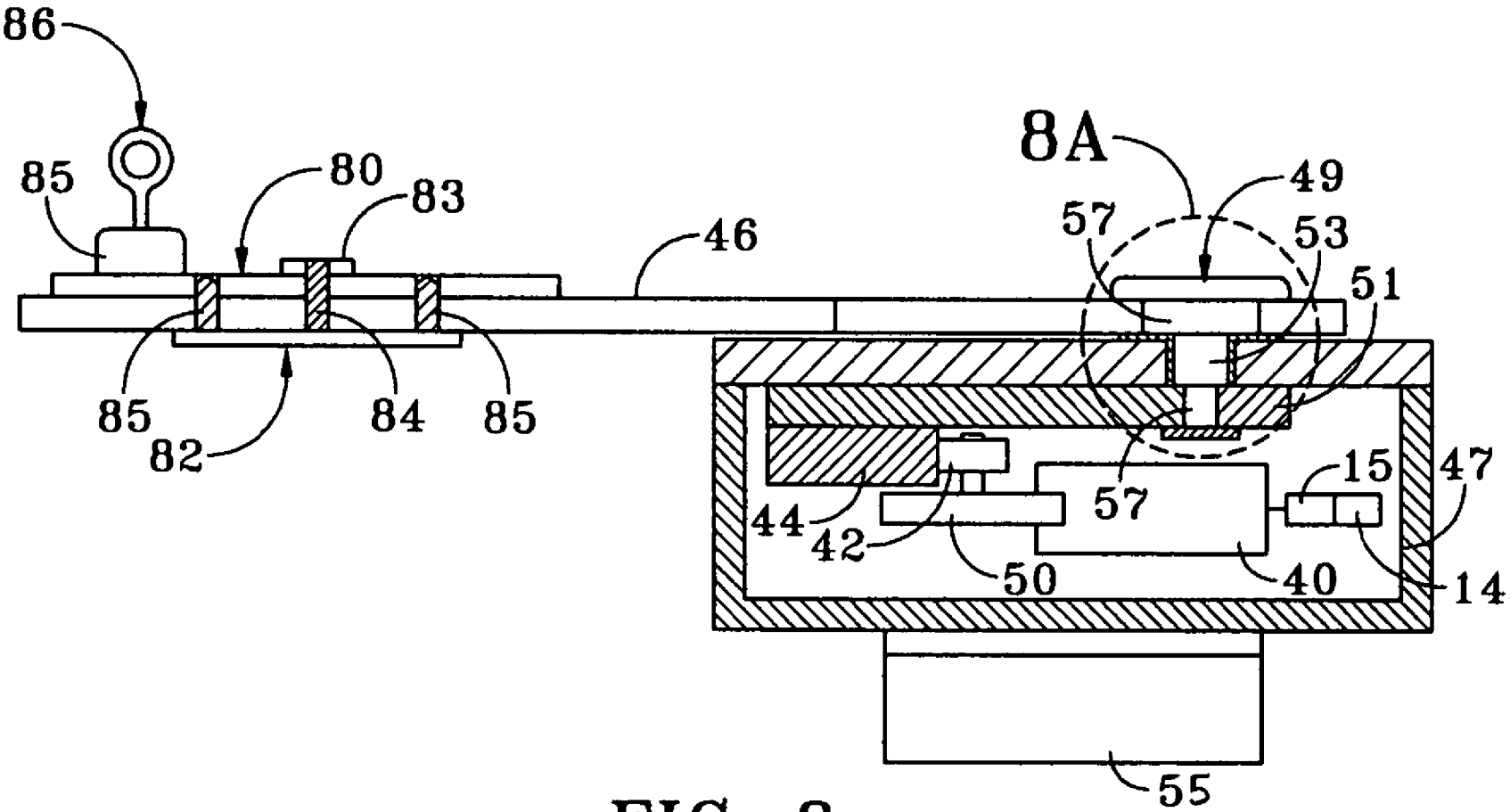
FIG. 8 is a side view of the third configuration.
Figure 9:
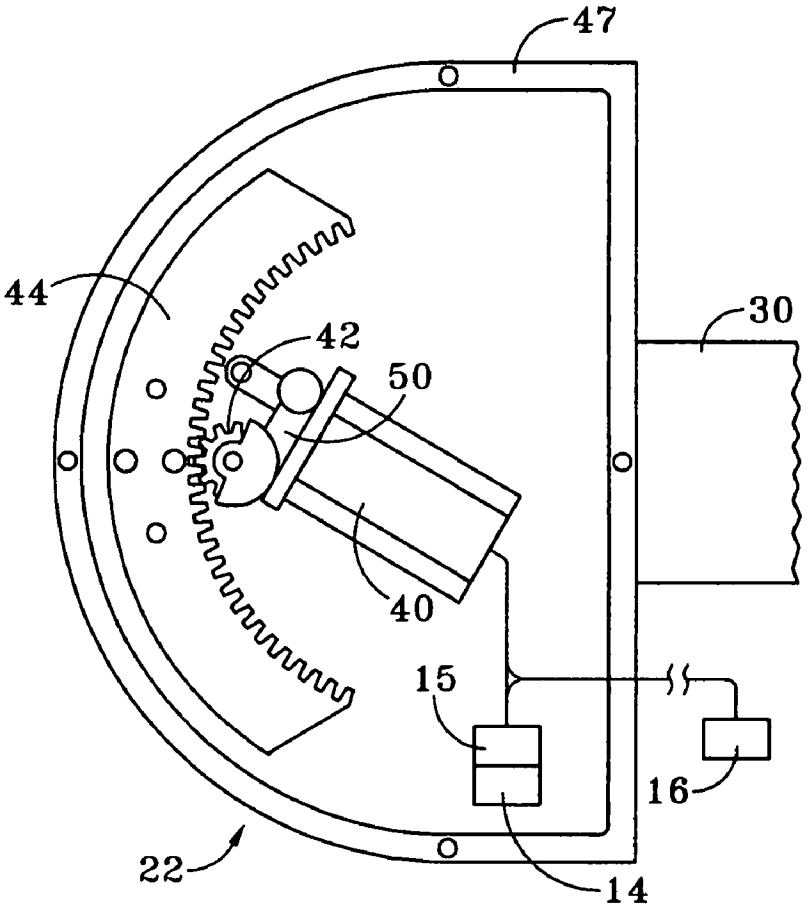
FIG. 9 is a view similar to FIG. 7 with the housing of the drive unit removed.
Figure 8A:
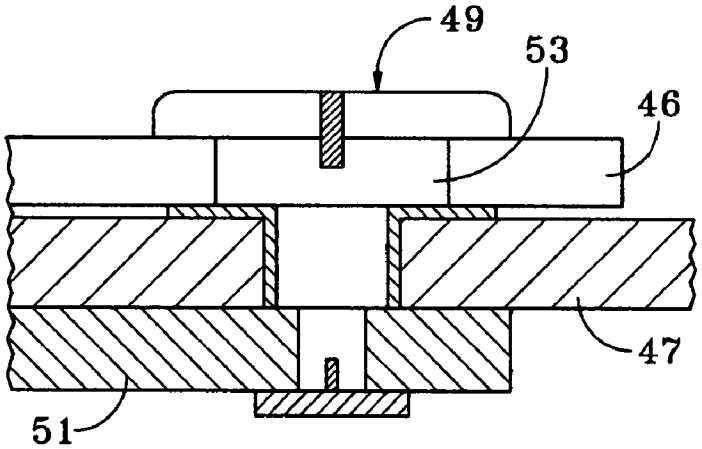
FIG. 8A is an enlarged section view of the connector used to secure the control arm to the rack.

Drive unit 22 generally includes a motor 40, a pinion gear 42, a rack 44, and a control arm 46. The position of control arm 46 is fixed with respect to rack 44. Control arm 46 may be integrally formed with rack 44. In the third configuration of the invention shown in FIGS. 7–9, control arm 46 is disposed outside a housing 47 while rack 44 is disposed inside housing 47. The fixed connection between arm 46 and rack 44 is achieved with a connector 49 that includes an inner connector arm 51 and a shaft 53. Arm 51 is fixed to rack and is non-pivotably connected to shaft 53. Shaft 53 passes through housing 47 (and may pass through a seal or bushing to keep housing 47 weatherproof and is non-pivotably connected to arm 46. The seal or bushing may be used to space arm 46 from the top of housing 47. Shaft 53 may be welded to arms 46 and 51. Shaft 53 may also be formed with non-circular portions 57 that engage corresponding non-circular openings in arms 46 and 51. The different sections of shaft 53 may be stepped so seat the portions of shaft 53 in the correct position. The end of shaft 53 inside housing is designed to receive a fastener that keeps all of the elements together in a reliable configuration. The fastener may thread directly into the end of shaft 53, may be a pin that passes through the end of shaft 53, may be a snap ring, or may be any of a variety of other fasteners used for this purpose. This configuration essentially clamps arms 46 and 51 to the top of housing 47 such that rack 44 is pivotably supported by housing 47.

Rack 44 includes a plurality of gear teeth 48 disposed along an arc that limits the adjustment of tiller 30 by drive unit 22. Rack 44 is concave with respect to gear 42. Rack 44 may extend through an arc of 120 to 150 degrees and include approximately 25 to 40 teeth. Pinion gear 42 is driven by motor 40 and meshingly engages teeth 48. Optionally, a transmission 50 may be used between pinion gear 42 and motor 40 to provide power to the system.

Figure 2:
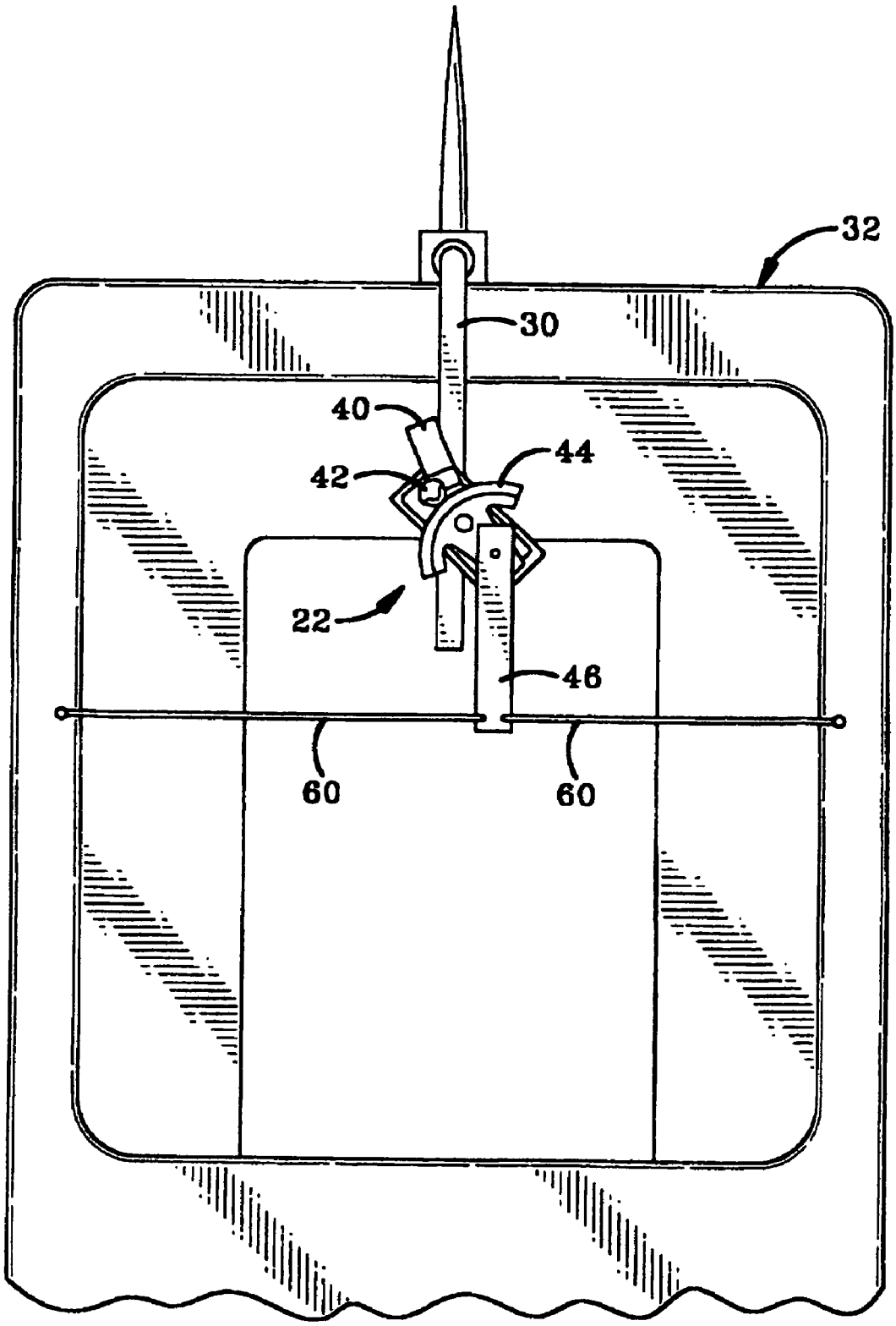
FIG. 2 is a top plan view of the cockpit and stern of a sailboat with the first configuration of the remote tiller controller installed on the tiller.
Figure 3:
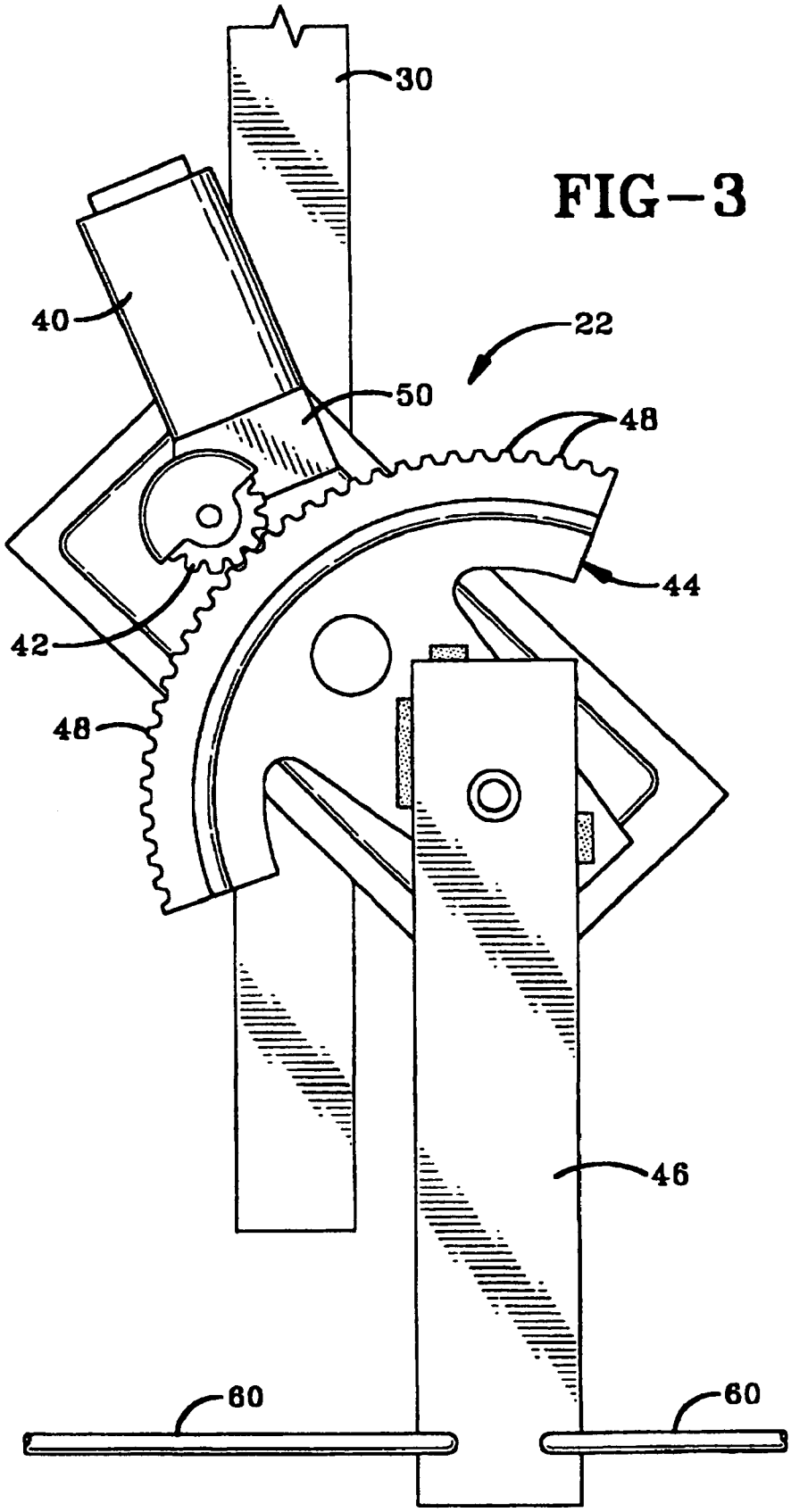
FIG. 3 is an enlarged view of the motor, gear, rack, and control arm of the remote tiller controller.
Figure 4:
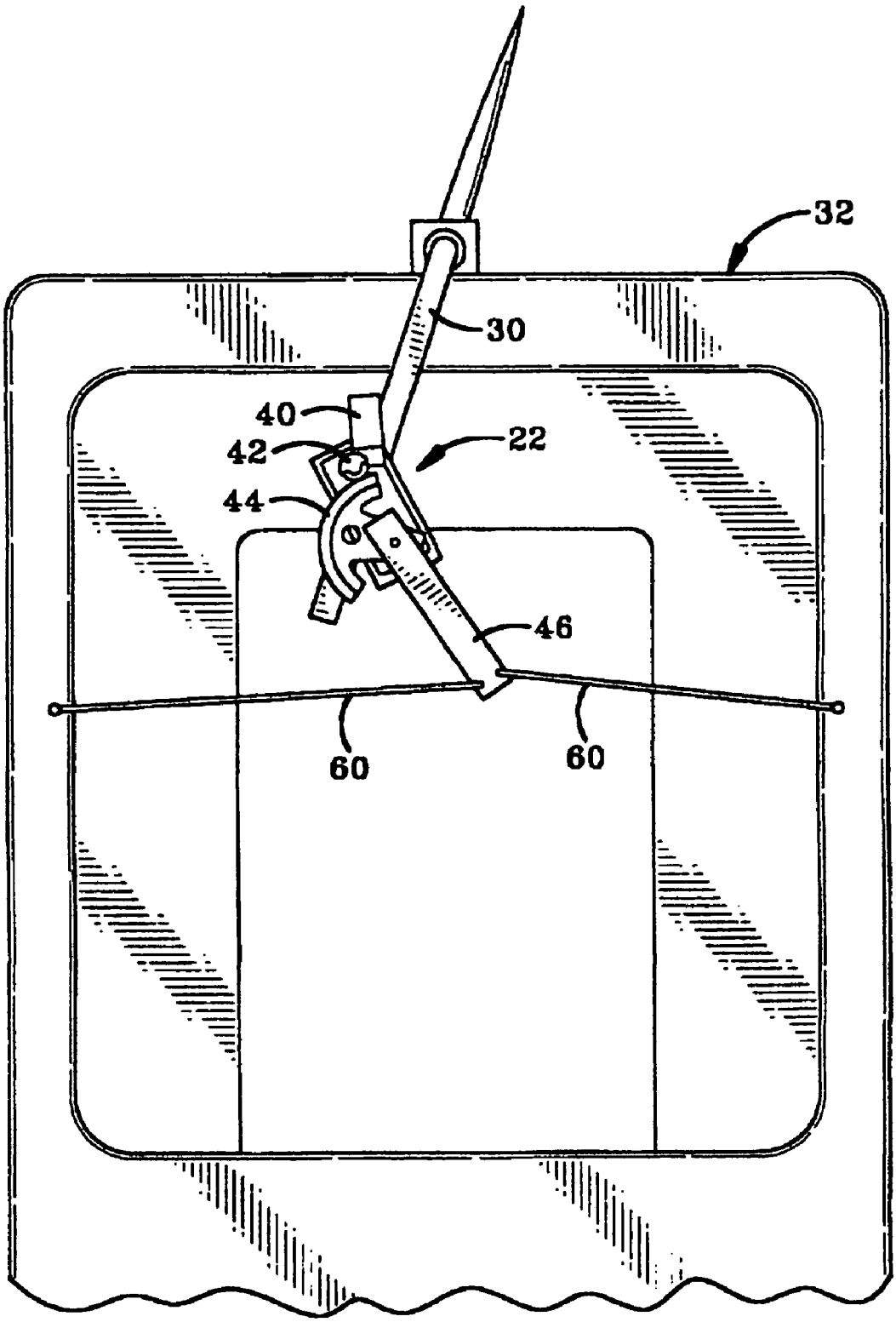
FIG. 4 is a view similar to FIG. 2 showing the tiller in a different position than FIG. 2.

In the first and third configurations, motor 40 is fixed with respect to tiller 30. Motor 40 may be directly clamped to tiller 30 allowing drive unit 22 to be retrofit onto existing tillers 30. As shown in FIG. 2, motor 40 may be mounted on the cockpit side of the rudder where tiller 30 typically extends. In another embodiment, tiller 30 may extend behind rudder (with respect to the boat) or a tiller extension may be used to support motor 40 (or unit 22) behind the rudder so that use of the boat's cockpit is not encumbered. In the third configuration, motor 40 is fixed to housing 47 and housing 47 is clamped or fastened to tiller 30 using a leg or clamp member 55. The outer end of control arm 46 is, however, connected to the hull of boat 32. Stays 60 may be used to hold arm 46 in position. In other embodiments, the forward end of arm 46 may be held in place with a single rigid arm that extends between the boat hull and the arm 46. Rotation of pinion gear 42 by motor 40 creates a moment that moves drive unit 22 and thus moves tiller 30 in the manner depicted in FIG. 4. Tiller 30 pivots about its connection to boat 32 and drive unit 22 moves about the end of arm 46.

In the third configuration, a lock slide 80 is adjustably connected to arm 46 to allow the user to adjust the tie-off position of stays 60 and adjust the length of the lever arm. In this configuration, arm 46 defines an elongated channel 81 along which lock slide 80 and its lock clamp 82 may slide to different positions. Lock clamp 82 and lock slide 80 sandwich a portion of arm 46. A nut 83 threadedly engages a threaded shaft 84 to tighten lock slide 80 in place. At least one shaft 85 or a pair of unthreaded shafts 85 are used to prevent lock slide 80 from pivoting. A threaded knob 85 is used to receive an eye or pulley 86 that receives stays 60. Notches 87 are provided to pinch the ends of stays 60. Lock slide 80 may be reversed on arm 46 to provide a position wherein knob 85 is disposed over the top of housing 47.

In another embodiment of the invention, one or more remote control transmitters may be built into different locations of the boat to allow the captain to control the steering system from different locations.

Figure 5:
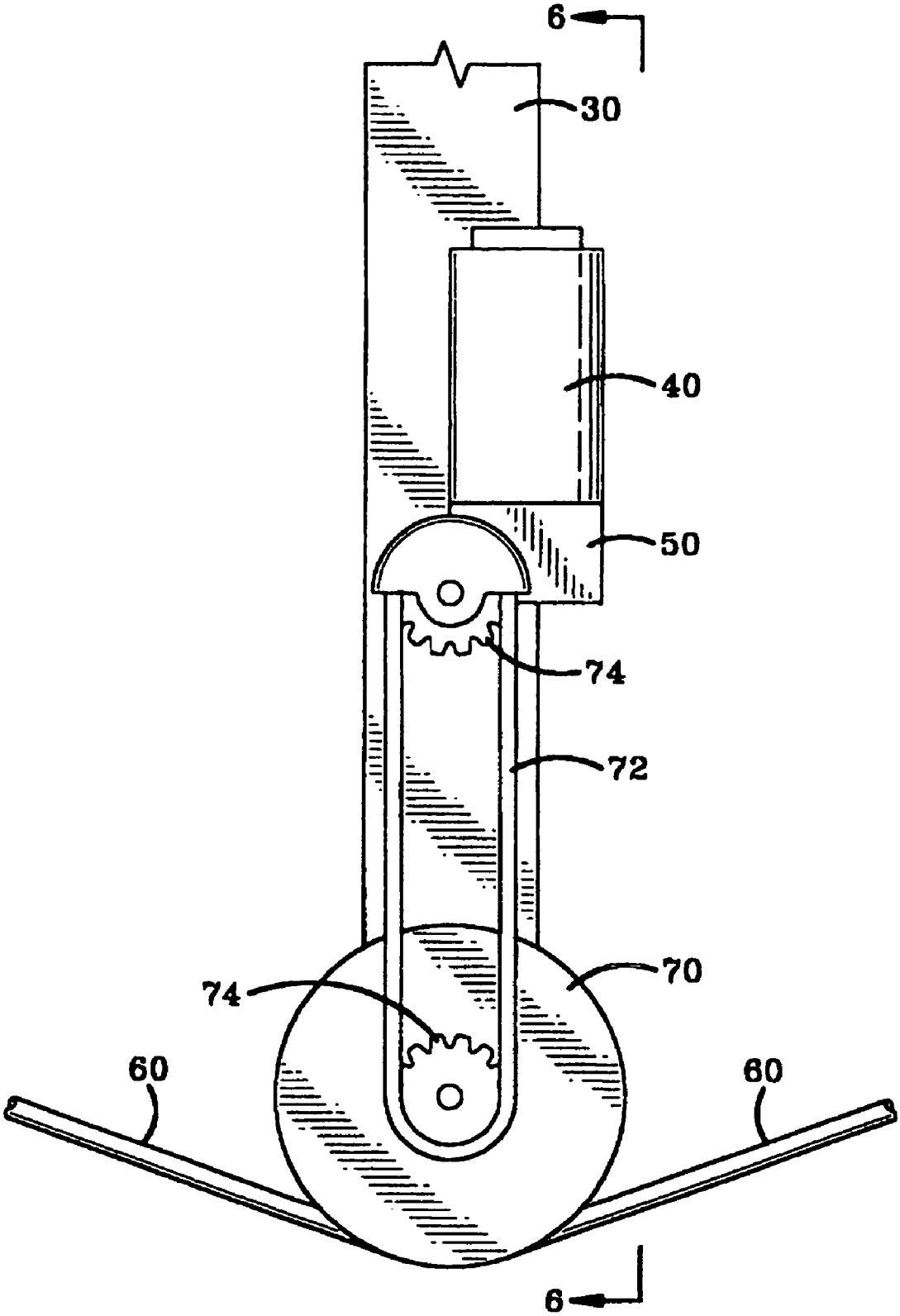
FIG. 5 is a top plan view of a second configuration of the remote tiller controller of the invention.
Figure 6:
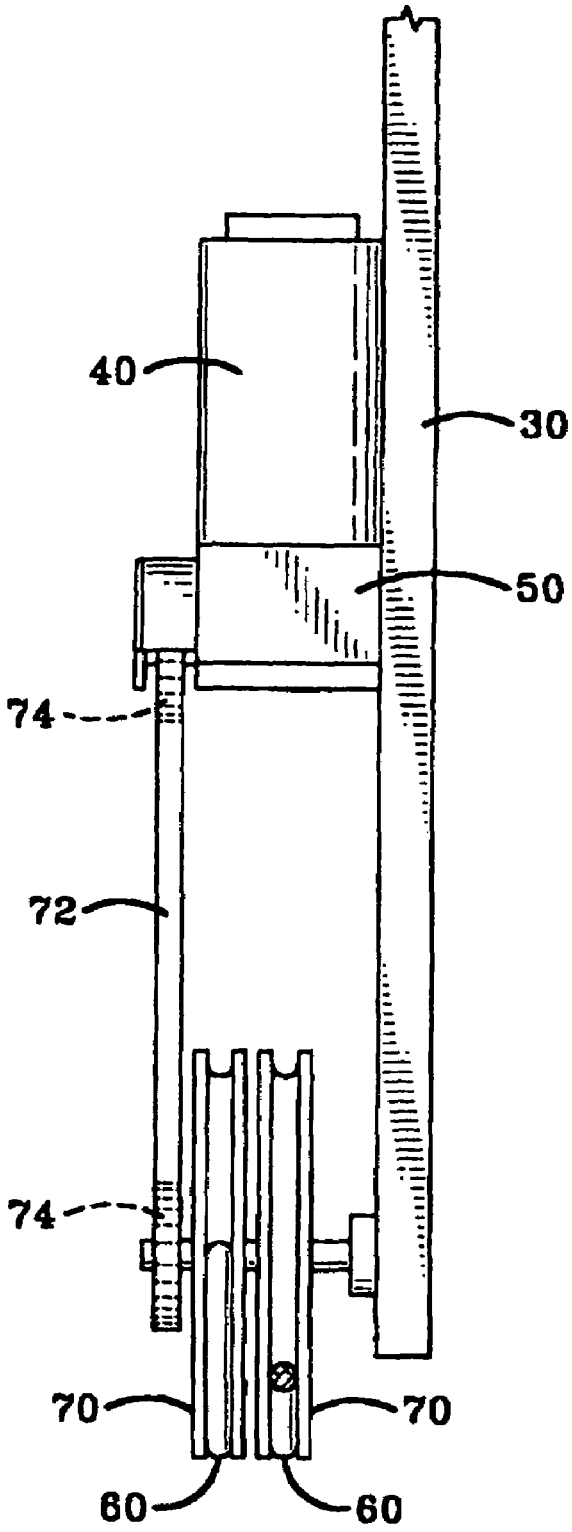
FIG. 6 is a side view of the alternative steering control unit of FIG. 5.

The second alternative configuration of the system is depicted in FIGS. 5 and 6 wherein a pair of pulleys 70 are driven by a motor 40. Pulleys 70 are connected to tiller 30. Stays 60 are wrapped around pulleys 70 in opposite directions such that the rotation of pulleys 70 pulls tiller in one direction or the other. Pulleys 70 may be driven with a chain 72 and a sprocket 74 drive as shown. Pulleys 70 may be driven by other transmissions.

In the foregoing description, certain terms have been used for brevity, clearness, and understanding. No unnecessary limitations are to be implied therefrom beyond the requirement of the prior art because such terms are used for descriptive purposes and are intended to be broadly construed. The elements of the system may be fabricated from weather proof materials such as stainless steel and aluminum. Appropriate plastics or composites may also be used. Any dimensions provided are for exemplary purposes. Moreover, the description and illustration of the invention is an example and the invention is not limited to the exact details shown or described.

The invention claimed is:

1. A tiller control system for use with a boat having a hull; the tiller being pivotably mounted to one portion of the hull of the boat; the system comprising:

a drive unit adapted to be fixed to the tiller;

the drive unit including a motor and a gear; the motor adapted to drive the gear in first and second directions; the first direction being opposite to the second direction;

the drive unit also including a rack having a plurality teeth disposed along an arc;

the gear meshingly engaging the teeth of the rack;

the rack being moveably mounted with respect to the motor; and a control arm connected to the rack; the control arm being adapted to be connected to a second portion of the hull of the boat such that rotation of the gear creates a force that moves the tiller with respect to the hull of the boat.

2. The system of claim 1, further comprising a remote control unit adapted to control the motor.

3. The system of claim 1, further comprising a housing; the motor, gear and rack being disposed in the housing.

4. The system of claim 3, further comprising a transmission connected to the motor and gear.

5. The system of claim 1, further comprising a lock slide connected to the control arm; the position of the lock slide being adjustable with respect to the control arm.

6. The system of claim 5, wherein the control arm defines an elongated slot; the lock slide including a lock clamp; the lock clamp having at least a pair of shafts disposed in the elongated slot of the control arm.

7. The system of claim 5, wherein the lock slide defines a plurality of notches adapted to pinch a stay.

8. A tiller control system for use with a boat having a hull; the tiller being pivotably mounted to one portion of the hull of the boat; the system comprising:

a transmitter having a switch movable between first, second, and neutral positions; the transmitter adapted to create and transmit a signal that represents the position of the switch;

a drive unit adapted to be fixed to the tiller;

the drive unit including a motor and a gear; the motor adapted to drive the gear in first and second directions; the first direction being opposite to the second direction;

the drive unit also including a rack having a plurality teeth disposed along an arc;

the gear meshingly engaging the teeth of the rack;

the rack being moveably mounted with respect to the motor;

a control arm connected to the rack; the control arm being adapted to be connected to a second portion of the hull of the boat such that rotation of the gear creates a force that moves the tiller with respect to the hull of the boat; and a motor controller adapted to receive the signal from the transmitter and control the operation of the motor in a manner that corresponds to the position of the switch of the transmitter.

9. The system of claim 8, further comprising a housing; the rack, gear, and motor being disposed inside the housing; the housing being adapted to be mounted to the tiller.

10. The system of claim 8, wherein the switch of the transmitter automatically returns to the neutral position.

11. The system of claim 8, further comprising a transmission connected to the motor and the gear.

12. A tiller control system for use with a boat having a hull; the tiller being pivotably mounted to one portion of the hull of the boat; the system comprising:

a transmitter having a switch adapted to create and transmit a signal that represents the position of the switch;

a drive unit adapted to be fixed to the tiller;

the drive unit including a motor and a gear; the motor adapted to drive the gear in first and second directions; the first direction being opposite to the second direction;

the drive unit also including a rack having a plurality teeth disposed along an arc;

the gear meshingly engaging the teeth of the rack;

the rack being moveably mounted with respect to the motor;

a control arm connected to the rack; the control arm being adapted to be connected to a second portion of the hull of the boat such that rotation of the gear creates a force that moves the tiller with respect to the hull of the boat;

a lock slide connected to the control arm; the lock slide being adjustable and reversible with respect to the control arm;

a lock slide clamp connected to the lock slide to sandwich a portion of the control arm between the lock slide clamp and the lock slide; and a motor controller adapted to receive the signal from the transmitter and control the operation of the motor in a manner that corresponds to the position of the switch of the transmitter.

13. The system of claim 12, wherein the rack is concave with respect to the gear.

14. The system of claim 12, wherein the transmitter is adapted to be worn on the wrist of the user.

15. The system of claim 12, wherein the control arm defines an elongated slot; the lock slide including a lock clamp; the lock clamp having at least a pair of shafts disposed in the elongated slot of the control arm.

16. The system of claim 15, wherein the lock slide defines a plurality of notches adapted to pinch a stay.

* * * * *